US009799980B2

(12) United States Patent
Jakoplic et al.

(10) Patent No.: US 9,799,980 B2
(45) Date of Patent: Oct. 24, 2017

(54) CONTACT FOR ELECTRICAL CONNECTORS

(71) Applicant: YAZAKI EUROPE LTD., Hemel Hempstead, Hertfordshire (GB)

(72) Inventors: Ivica Jakoplic, Krapinske Toplice (HR); Dragan Babic, Zagreb (HR); Mario Sprljan, Velika Gorica (HR)

(73) Assignee: YAZAKI EUROPE LTD., Hertfordshire (GB)

( * ) Notice: Subject to any disclaimer, the term of this patent is extended or adjusted under 35 U.S.C. 154(b) by 0 days.

(21) Appl. No.: 15/151,597

(22) Filed: May 11, 2016

(65) Prior Publication Data

US 2016/0344129 A1 Nov. 24, 2016

(30) Foreign Application Priority Data

May 22, 2015 (EP) ..... 15169011

(51) Int. Cl.

| | |
|---|---|
| ***H01R 13/11*** | (2006.01) |
| ***H01R 13/428*** | (2006.01) |
| ***H01R 13/187*** | (2006.01) |
| ***H01R 4/18*** | (2006.01) |

(52) U.S. Cl.

CPC ..... *H01R 13/428* (2013.01); *H01R 4/185* (2013.01); *H01R 13/113* (2013.01); *H01R 13/187* (2013.01)

(58) Field of Classification Search

CPC ... H01R 13/187; H01R 13/111; H01R 13/113; H01R 13/185; H01R 4/185; H01R 4/188

USPC ..... 439/843, 877, 845, 852

See application file for complete search history.

(56) References Cited

U.S. PATENT DOCUMENTS

| | | | | |
|---|---|---|---|---|
| 5,951,336 A * | 9/1999 | Seko | ..... | H01R 13/432 439/745 |
| 6,019,646 A * | 2/2000 | Okamura | ..... | H01R 13/113 439/748 |
| 6,394,858 B1 * | 5/2002 | Geltsch | ..... | H01R 13/114 439/843 |
| 7,048,582 B2 * | 5/2006 | Tabata | ..... | H01R 13/113 439/595 |

(Continued)

FOREIGN PATENT DOCUMENTS

| | | |
|---|---|---|
| DE | 43 12 641 A1 | 10/1994 |
| DE | 195 36 500 A1 | 4/1997 |
| DE | 692 21 539 T2 | 1/1998 |

(Continued)

*Primary Examiner* — Hien Vu

(74) *Attorney, Agent, or Firm* — Sughrue Mion, PLLC

(57) ABSTRACT

A contact for electrical connectors including a contact member, a box-shaped hood extending along a longitudinal axis and enclosing at least partially the contact member, the sheet-metal part having a first connection portion with a first abutment edge and a second connection portion with a second abutment edge wherein the first and second abutment edges abut each other, wherein the first connection portion is provided with a first connection element at the front side, and the second connection portion is provided with a second connection element at the front side, and the first connection element and the second connection element engage each other so as to lock the first connection portion and the second connection portion against detaching the first and second connection portions away from each other.

7 Claims, 3 Drawing Sheets

(56) References Cited

U.S. PATENT DOCUMENTS 7,419,410 B2 * 9/2008 Myer ..... H01R 13/113
439/852

FOREIGN PATENT DOCUMENTS

| | | | |
|---|---|---|---|
| EP | 1 780 835 | B1 | 12/2010 |
| EP | 2 642 598 | A1 | 9/2013 |
| JP | 08-306420 | A | 11/1996 |
| WO | 88/05611 | A1 | 7/1988 |

* cited by examiner

CONTACT FOR ELECTRICAL CONNECTORS

BACKGROUND OF THE INVENTION

Field of the Invention

The invention relates to a contact for electrical connectors. The contact comprises a contact member and a box-shaped hood extending along a longitudinal axis and enclosing at least partially the contact member. The hood is bent from a sheet-metal part into the box-shape having four outer walls extend along the longitudinal axis. The hood has a front side with an opening for inserting a counter contact member in the direction of the longitudinal axis into the box-shaped hood for contacting the contact member. The sheet-metal part has a first connection portion with a first abutment edge and a second connection portion with a second abutment edge wherein the first and second abutment edges abut each other.

Background

A multitude of such contacts are for example provided in connectors, used in motor vehicles on wire harnesses or for connecting electrically operated equipment elements of a motor vehicle. Such connectors have housings, in which often in several rows, one on top of another and next to each other cavities are formed, which, respectively, accommodate a contact. Additionally to each cavity a locking element in form of an elastic arm is arranged, which rests with a projection behind a corresponding contour of the contact and especially its support element, so that the contact is securely retained against pulling-out from the housing. Alternatively, the contact is provided with elastic arms which engage recesses of the housing. Often so-called secondary locking means are also provided. Even if pulling forces act on the cable connected to the individual contact, the contact should be securely held within the connector housing.

In one specific type of contacts the function of securing the contact within the connector housing and the function of the electric connection to a counter contact are separated into different elements of the contact. One element being the contact member for establishing an electrical connection to a counter contact and one element being a hood, enclosing at least partially the contact member, and provided with means for a mechanical connection or fixation of the contact within the connector housing. The advantage of this is that the contact member can be made of a material providing best electrical properties and the hood can be made of a material providing best mechanical properties.

EP 1 780 835 B1 describes a female contact. Disclosed is a housing having several cavities, to which respectively a locking arm is arranged, which abuts a projection on a female contact. The female contact shown comprises a contact member having a connection section with crimping tabs for connecting a cable. The contact member further is provided with a contact section achieving an electrically conductive contact with a complementary contact pin or contact blade of a counter contact. The contact section has elastic contact arms integrally formed to the contact member. The contact section is enclosed by a box-shaped hood. The hood has four outer walls, forming in cross-section a hollow rectangle. The four outer walls are formed by bending a sheet-metal part into the box-shaped design, wherein the sheet-metal part has two connection portions each having an abutment edge. The abutment edges of the two connection portions are bent towards each other forming a seam along the extent of the hood. The box-shaped hood is secured by welding points along the seam. The hood has a relative smooth surface so that, when inserting such a female contact into a cavity of a connector closed by a seal, no damage is produced to the seal. However, the hood is cumbersome to manufacture and necessitates a bending manufacturing step and a welding manufacturing step.

EP 2 642 598 A1 describes a contact, in particular a female contact. The adjoining connection portions of the sheet-metal part are form-fittingly connected to each other in a mechanical manner. Therefore, it is not necessary anymore to secure the two connection portions to each other by welding or soldering. The form fitting connection can be achieved by just bending the sheet-metal part. Hence, one of the manufacturing steps according to the prior art, i.e. the welding or soldering step, can be avoided.

It is the object of the invention to provide a contact having a hood which can be manufactured even more easily.

SUMMARY OF THE INVENTION

The object is achieved by a contact as described and claimed herein

The connection portions are held in place by only the engagement of the first and second connection elements. The adjoining abutment edges do not need to be provided with mechanically closing elements so that the design of the tools for cutting such sheet-metal parts are less complex. The abutment edges are arranged substantially like a seam along one or several straight lines without much diversions as they would occur in the prior art in order to form connection elements at the abutment edges.

The function of locking the first connection portion and the second connection portion is separated from the abutment edges and are located at the front side of the box-shaped hood in form of the first and second connection elements.

In a preferred embodiment the first connection element is a first flap which is integral with a first outer wall of said four outer walls and is provided at the opening. The first flap is bent inwardly. In addition, the second connection portion is a second flap which is integral with a second outer wall of said four outer walls wherein the second flap is also provided at the opening and is bent inwardly.

In order to provide a locking between the first flap and the second flap the first flap can have a slot which is engaged by the second flap. The slots starts from an inner edge of the flap and is directed outwardly. The second flap engages the slot with a portion which is orientated parallel to the longitudinal axis. Hence, the second flap is supported within the slot against the first flap in a direction transverse to the longitudinal axis.

In one embodiment the complete first connection portion forms the first outer wall and the complete second connection portion forms the second outer wall. According to another embodiment, one of the first and second connection portions can be provided with an extended portion which is bent into a plane of the other one of the first and second connection portions and wherein said extended portion forms together with the other connection portion one of the outer walls of the box-shaped hood.

According to one preferred embodiment the second connection portion has the extended portion which is bent into a plane of the first connection portion and the extended portion forms together with the first connection portion one of the outer walls of the box-shaped hood.

The second flap can be bent inwardly and backwards such that the flap enters the hood through the opening. This means that the second flap is formed, viewed in a cross section parallel to the longitudinal axis, substantially L-shaped or, in other words, forms a U-shape together with the second connection portion.

The second flap can have an engagement portion arranged parallel to the second connection portion. A contact arm of the contact member can reach between the engagement portion and the second connection portion so that the contact arm is protected by the second connection portion and the second flap.

The engagement portion can be integral with a base portion which connects the engagement portion with the second connection portion. The engagement portion of the second flap engages the slot of the first flap. A support portion of the first flap, which is adjacent to the slot, is located between the base portion and the contact member and is supported against the base portion in a first longitudinal direction.

The first and second abutment edges can be provided with a step which supports the first and second abutment edges against each other and against a movement in a second longitudinal direction, wherein the second longitudinal direction preferably is opposite to the first longitudinal direction. Hence, the first and second connection portions are supported against movement in both directions of the longitudinal axis.

BRIEF DESCRIPTION OF THE DRAWINGS

A preferred embodiment of a contact will be described by way of example with respect to the figures.

FIGS. 1 to 3 are different perspective views of a contact according to the invention and are described together.

DETAILED DESCRIPTION OF THE INVENTION

Figure 1:
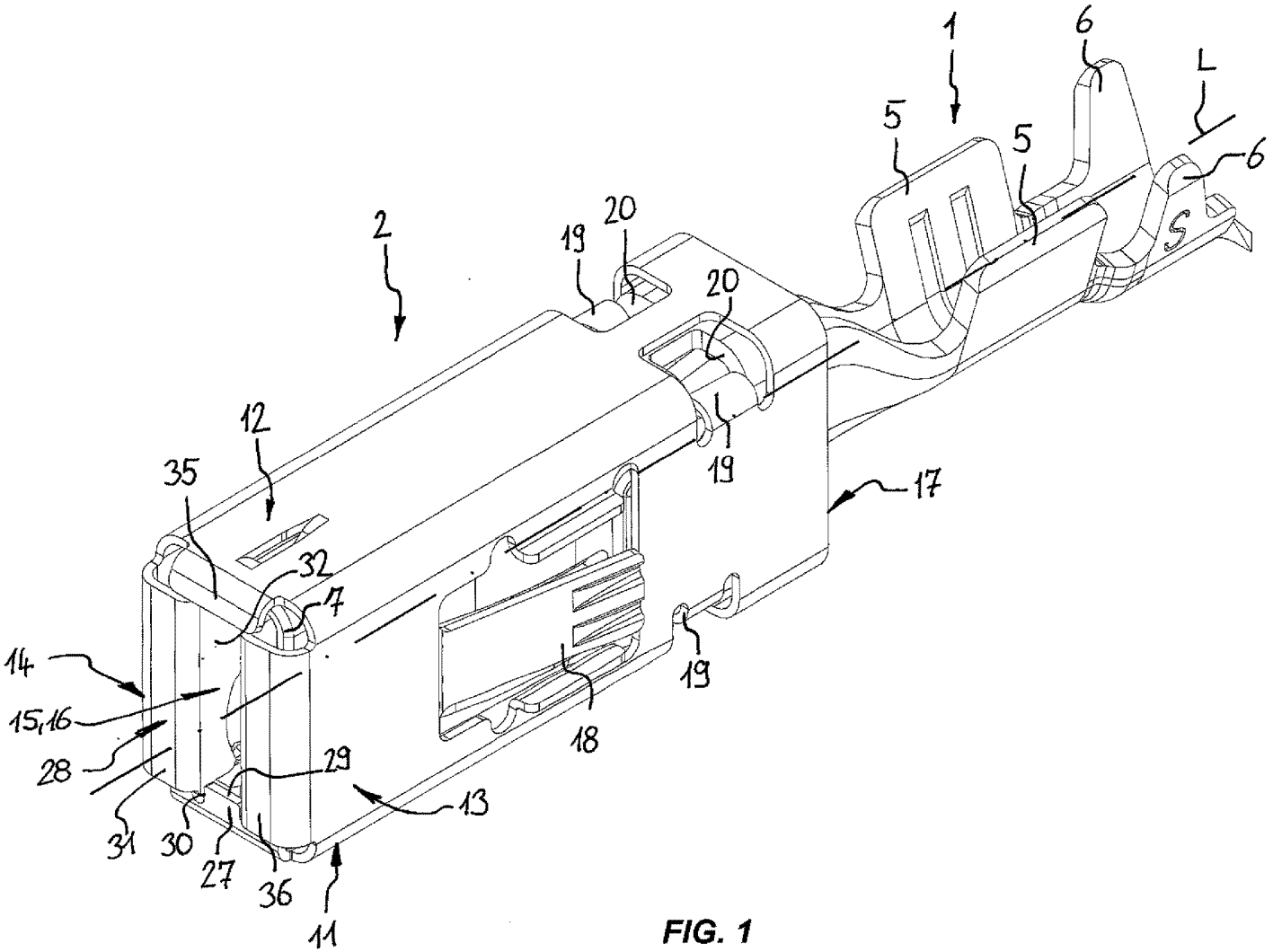
FIG. 1 is a perspective top view of a contact.
Figure 2:
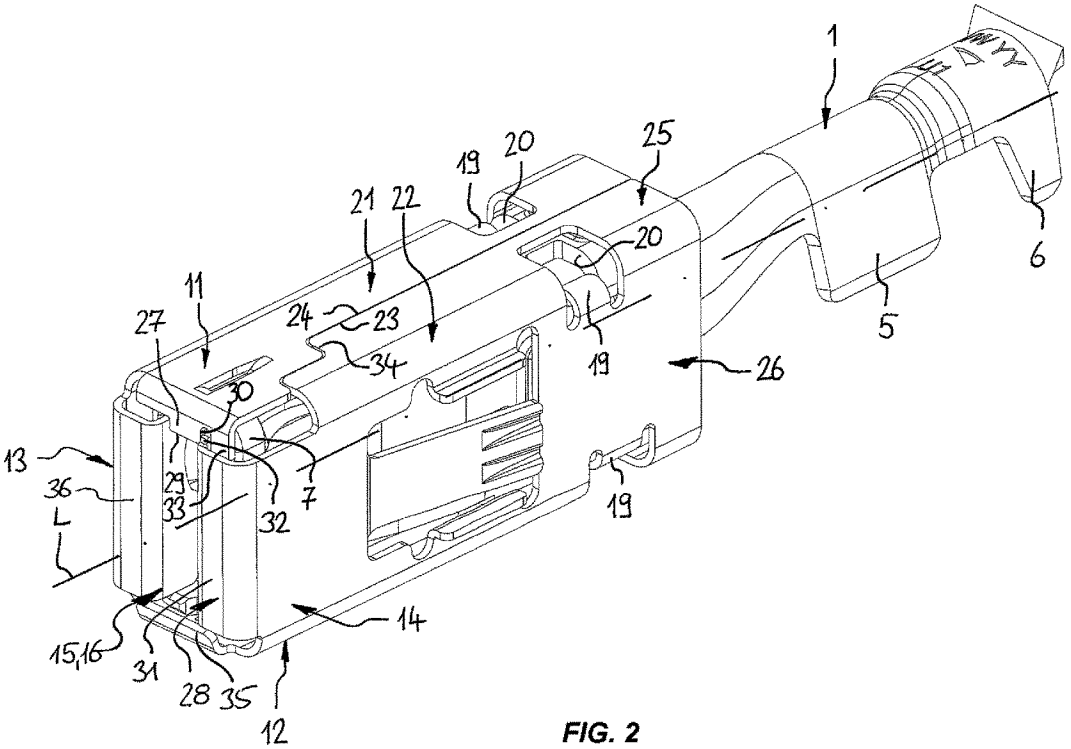
FIG. 2 is a perspective bottom view of the contact according to FIG. 1.

The contact comprises a contact member 1 and a box-shaped hood 2 which encloses the contact member 1 over a partial length of the contact member 1 along a longitudinal axis L.

The contact member 1 is manufactured from a sheet-metal part by means of bending wherein the sheet-metal part is made of a material having a good electrical conductivity, such as copper or a copper alloy. A contact member 1 comprises a connection section 3 and a contact section 4. The connection section 3 has two first crimping tabs 5 for connecting an electrical conductor of a cable to the contact member 1 by means of crimping in order to establish an electrical contact between the conductor of the cable and the contact member 1. Furthermore, two second crimping tabs 6 are provided. The second crimping tabs 6 can be crimped to an insulation of the cable.

The contact section 4 is integrally formed to the connection section 3 having a hollow rectangular profile 10, wherein at the end thereof, which faces away from the connection section 3, four contact arms 7 are provided. The contact arms 7 are formed elastically and serve to accommodate and to contact a counter contact, e.g. a contact blade. Each contact arm 7 has an L-cross-section wherein the contact arms 7 each have one spring arm 8 and one support arm 9 which are integrally connected to the rectangular profile 10 at one end and are connected to each other at a free end remote from the rectangular profile 10. In a cross-sectional view the spring arm 8 and the support arm 9 of each contact arm 7 are orientated perpendicular to each other, so that the spring arm 8 forms one leg of the L-shaped cross-section and the support arm 9 forms the other leg of the L-shaped profile.

The hollow rectangular profile 10 and the contact arms 7 are enclosed by the hood 2.

The hood 2 has a hollow rectangular cross-section transversely to the longitudinal axis L. The hollow rectangular cross-section is formed by four outer walls, namely a bottom wall 11, an opposite top wall 12, a first side wall 13 perpendicular to the bottom wall 11 and the top wall 12 and a second side wall 14 opposite to the first side wall 13. The bottom wall 11, the top wall 12 and the side walls 13, 14 extend parallel to the longitudinal axis L and surround the longitudinal axis L. The hood 2 further comprises a front side 15 with an opening 16 which is arranged at an end of the hood 2 facing away from the connection section 3 of the contact member 1. The front side 15 with the opening 16 serves to accommodate a counter-contact member which can be inserted through the opening 16 into the hood 2 in a first direction along the longitudinal axis L.

Opposite to the front side 15 the hood 2 has a back side 17 which is open and through which the contact member 1 can be inserted into the hood 2 in a second direction along the longitudinal axis L, which second direction is opposite to the first direction.

Figure 3:
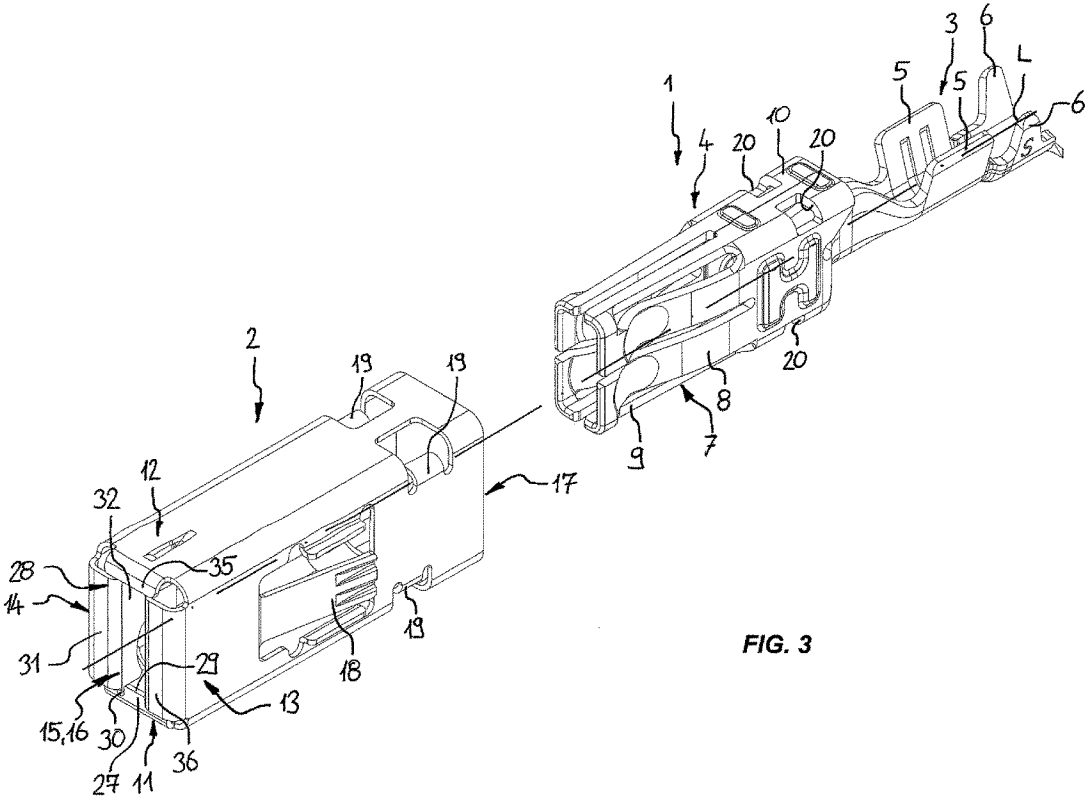
FIG. 3 is a perspective exploded top view of the contact according to FIG. 1.

The definitions bottom, top, side, front and back refer to the perspective according to FIGS. 1 and 3. However, these definitions only serve to differentiate the different sides and walls and are not to be understood as limitations in regard to the general orientation of the contact, for example within a connector housing.

The hood 2 is formed, starting from a sheet-metal part, having a corresponding preform, wherein this is preferably made from a material which has a higher strength than the contact member 1. Preferably a steel is used, especially a steel having spring characteristics and which is non-corrosive.

The hood 2 has two locking lances 18 each of which is integrally formed to one of the side walls 13, 14 and projects from the side walls 13, 14 angled in an acute angle and extending rearwards. The locking lances 18 are locking the hood 2 within a cavity of a connector housing.

In the area of the back side 17 the hood 2 has four lugs 19 cut out of the sheet-metal material and bent inwardly. The lugs 19 engage into holes 20 of the hollow rectangular profile 10 of the contact member 1 so that the hood 2 is securely fixed to the contact member 1.

The sheet-metal part of the hood 2 has a first connection portion 21 and a second connection portion 22 which substantially extend in direction of the longitudinal axis L. The first connection portion 21 terminates in a first abutment edge 23 and the second connection portion 22 terminates in a second abutment edge 24. Both abutment edges 23, 24 also extend substantially parallel to the longitudinal axis L. The sheet-metal part is bent such that the first and second connection portions 21, 22 are bent towards each other and abut each other at least partially along the extension of the first and second abutment edges 23, 24. Abutting means that the first and second connection portions 21, 22 are in contact to each other or are orientated parallel to each other almost in contact forming a kind of a seam.

The first connection portion 21 forms a part of the bottom wall 11. The second connection portion 22 comprises a wall portion 26 which forms the second side wall. The second connection portion 22 further comprises an extended portion 25 integral with the wall portion 26 which extended portion 25 is bent perpendicular to the wall portion 26 towards the first connection portion 21. The extended portion 25 is bent such that it is in one plane with the first connection portion 21 and forms together with the first connection portion 21 the bottom wall 11. The seam formed by the first and second abutment edges 23, 24, hence, divides the bottom wall 11 into the first connection portion 21 and the extended portion 25.

Alternatively it is also possible that the seam formed by the first and second abutment edges 23, 24 extends along an edge between the bottom wall 11 and the second side wall 14. In such an embodiment the second connection portion 22 would not be provided with an extended portion 25.

The first and second connection portions 21, 22 are not connected to each other by welding or soldering. The first and second connection portions 21, 22 are mechanically connected to each other. For such a mechanical connection the first connection portion 21 is provided with a first connection element and the second connection portion 22 with a second connection element each at the front side 15 of the hood 2. The first connection element is provided in the form of a first flap 27 and the second connection element is provided in the form of a second flap 28. The first flap 27 is integral to the first connection portion 21 and is bent inwardly in the region of the opening 16. The first flap 27 is orientated perpendicular to the longitudinal axis L. The first flap 27 has a slot 30 which starts from an inner edge 29 of the first flap 27 and is directed outwardly.

The second flap 28 has a base portion 31 which is integral with the wall portion 26 of the second connection portion 22. The base portion 31 is bent inwardly in the area of the opening 16 and is substantially perpendicular to the second side wall 14 and the longitudinal axis L. An engagement portion 32 of the second flap 28 is integrally connected to the base portion 31 and is bent inwardly from the front side 15 into the hood 2. The engagement portion 32 is orientated parallel to the second side wall 14 and to the longitudinal axis L and engages the slot 30. By the engagement of the engagement portion 32 into the slot 30 the first and second connection portions 21, 22 are supported against a movement or bending of the first and second connection portions 21, 22 in a direction transverse to the longitudinal axis L and in the plane of the bottom wall 11. Therefore, the first and second connection portions 21, 22 are secured against a movement away from each other.

Further, the first flap 27, viewed in the direction of the longitudinal axis L, reaches behind the base portion 31 with a support portion 33. The support portion 33 is located between the base portion 31 and one of the contact arms 7 of the contact member 1. The support portion 33, hence, is limiting a movement of the first and second connection portions 21, 22 relative to each other in one direction along the longitudinal axis L.

Further, the first and second abutment edges 23, 24 form a step along their extension supporting the first and second connection portions 21, 22 against each other in another longitudinal direction along the longitudinal axis L.

Thus, the support portion 33 and the step 34 together avoid any deformation or movement of the first and second connection portions 21, 22 relative to each other in any direction along the longitudinal axis L.

The top wall 12 is integrally connected with a third flap 35 which is arranged mirror symmetrically to the first flap 27. The first side wall 13 is provided with a fourth flap 36 which is arranged mirror symmetrical to the second flap 28. The third flap 35 is also substantially arranged perpendicular to the longitudinal axis L. The fourth flap 36 is comparable designed to the second flap 28 having a base portion and an engagement portion. The second flap 28 and the fourth flap 36 also protect the contact arms 7 which are partially arranged between the engagement portion 32 and the respective side wall 13, 14.

The invention claimed is:

1. A contact for electrical connectors, said contact comprising:

a contact member, a box-shaped hood extending along a longitudinal axis and enclosing at least partially the contact member, said hood being bent from a sheet-metal part into the box-shape having four outer walls extend along the longitudinal axis and having a front side with an opening for inserting a counter contact member in the direction of the longitudinal axis into the box-shaped hood for contacting the contact member, said sheet-metal part having a first connection portion with a first abutment edge and a second connection portion with a second abutment edge wherein the first and second abutment edges abut each other, wherein:

the first connection portion is provided with a first connection element at the front side, the second connection portion is provided with a second connection element at the front side, the first connection element and the second connection element engage each other so as to lock the first connection portion and the second connection portion to each other, the first connection element is a first flap integral with a first outer wall of said four outer walls provided at the opening and being bent inwardly, and wherein the second connection element is a second flap integral with a second outer wall of said four outer walls provided at the opening and being bent inwardly, and the second flap is bent inwardly and backwards such that the second flap enters the hood through the opening.

2. The contact according to claim 1, wherein the first flap has a slot and the second flap engages said slot.

3. The contact according to claim 1, wherein one of the first and second connection portions has an extended portion being bent into a plane of the other one of the first and second connection portions and wherein said extended portion forms together with the other connection portion one of the outer walls of the box-shaped hood.

4. The contact according to claim 3, wherein the second connection portion has the extended portion bent into a plane of the first connection portion and wherein the extended portion forms together with the first connection portion one of the outer walls of the box-shaped hood.

5. The contact according to claim 1, wherein the second flap has an engagement portion arranged parallel to a wall portion of the second connection portion and wherein a contact arm of the contact member reaches between the engagement portion and the wall portion.

6. The contact according to claim 5, wherein the engagement portion is integral with a base portion connecting the engagement portion to the wall portion, wherein the engagement portion of the second flap engages the slot of the first flap, and wherein a support portion of the first flap is located between the base portion and the contact member and is supported against the base portion in a first longitudinal direction.

7. The female contact according to claim 1, wherein the first and second abutment edges have a step supporting each other against movement in a second longitudinal direction.

* * * * *